US011337020B2

(12) United States Patent
Leppänen et al.

(10) Patent No.: US 11,337,020 B2
(45) Date of Patent: May 17, 2022

(54) CONTROLLING RENDERING OF A SPATIAL AUDIO SCENE

(71) Applicant: Nokia Technologies Oy, Espoo (FI)

(72) Inventors: Jussi Leppänen, Tampere (FI); Lasse Laaksonen, Tampere (FI); Arto Lehtiniemi, Lempäälä (FI); Antti Eronen, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 17/053,297

(22) PCT Filed: May 29, 2019

(86) PCT No.: PCT/EP2019/063969

§ 371 (c)(1),
(2) Date: Nov. 5, 2020

(87) PCT Pub. No.: WO2019/233855

PCT Pub. Date: Dec. 12, 2019

(65) Prior Publication Data

US 2021/0076152 A1 Mar. 11, 2021

(30) Foreign Application Priority Data

Jun. 7, 2018 (EP) ..... 18176444

(51) Int. Cl.
*H04S 7/00* (2006.01)
*H04S 3/00* (2006.01)

(52) U.S. Cl.
CPC ..... *H04S 7/302* (2013.01); *H04S 3/008* (2013.01)

(58) Field of Classification Search
CPC ..... H04S 2400/11; H04S 2420/01; H04S 2400/01; H04S 7/30; H04S 7/302; H04S 7/301; H04S 7/303; H04R 5/04; H04R 5/02; H04R 3/12; H04R 2499/13; H04R 2201/401; H04R 2205/024
USPC ..... 381/310, 306, 307, 303
See application file for complete search history.

(56) References Cited

U.S. PATENT DOCUMENTS

| | | | | |
|---|---|---|---|---|
| 5,870,484 | A | 2/1999 | Greenberger | |
| 10,225,656 | B1 * | 3/2019 | Kratz | G06F 3/011 |
| 2008/0273722 | A1 | 11/2008 | Aylward et al. | |
| 2011/0157327 | A1 | 6/2011 | Seshadri et al. | |
| 2017/0374465 | A1 | 12/2017 | Family et al. | |
| 2018/0124543 | A1 | 5/2018 | Leppanen et al. | |
| 2019/0036720 | A1 * | 1/2019 | Knudson | H04L 12/1895 |

(Continued)

FOREIGN PATENT DOCUMENTS

| | | | |
|---|---|---|---|
| WO | 2017/118983 | A1 | 7/2017 |
| WO | 2019/192864 | A1 | 10/2019 |

OTHER PUBLICATIONS

"The Speakers of the House", Apple, Retrieved on Oct. 27, 2020, Webpage available at: https://www.apple.com/homepod/.

(Continued)

*Primary Examiner* — Alexander Krzystan
(74) *Attorney, Agent, or Firm* — Alston & Bird LLP

(57) ABSTRACT

An apparatus comprising means for: obtaining an indication of a position of at least one user in real space; mapping the position of the user in real space to a position of the user in a sound space; and controlling an output audio signal, for rendering a sound scene via multiple audio channels, to provide rendering of a first sub-set of sound sources via at least a first sub-set of the multiple audio output channels and rendering a second sub-set of sound sources via at least a second sub-set of the multiple audio output channels, wherein an allocation of a plurality of sound sources to the first sub-set of sound sources or the second sub-set of sound sources is dependent upon at least a position of the user in the sound space; wherein an allocation of the multiple audio output channels to the first sub-set of the multiple audio output channels or the second sub-set of the multiple audio output channels is dependent upon available audio paths for the multiple audio output channels.

20 Claims, 6 Drawing Sheets

(56) References Cited

U.S. PATENT DOCUMENTS

| | | | | |
|---|---|---|---|---|
| 2020/0008003 | A1* | 1/2020 | Thompson | G06F 3/165 |
| 2021/0014630 | A1* | 1/2021 | Leppanen | G06F 3/011 |
| 2021/0076152 | A1* | 3/2021 | Leppanen | H04S 7/302 |
| 2021/0258690 | A1* | 8/2021 | De Bruijn | H04R 5/04 |

OTHER PUBLICATIONS

"Information Technology—High Efficiency Coding and Media Delivery in Heterogeneous Environments—Part 3: 3D Audio", ISO/IEC DIS 23008-3, ISO/IEC JTC 1/SC 29/WG 11, Jul. 25, 2014, 433 pages.

"This is how Valve's Amazing Lighthouse Tracking Technology Works", Gizmodo, Retrieved on Oct. 26, 2020, Webpage available at: https://gizmodo.com/this-is-how-valve-s-amazing-lighthouse-tracking-technol-1705356768.

Extended European Search Report received for corresponding European Patent Application No. 18176444.0, dated Nov. 30, 2018, 10 pages.

International Search Report and Written Opinion received for corresponding Patent Cooperation Treaty Application No. PCT/EP2019/063969, dated Aug. 28, 2019, 14 pages.

Office action received for corresponding European Patent Application No. 18176444.0, dated Oct. 27, 2020, 6 pages.

Office Action for European Application No. 18176444.0 dated Jan. 5, 2022, 5 pages.

First Examination Report for Indian Application No. 202047057270 dated Jan. 5, 2022, 9 pages.

* cited by examiner

CONTROLLING RENDERING OF A SPATIAL AUDIO SCENE

RELATED APPLICATION

This application claims priority to PCT Application No. PCT/EP2019/063969, filed on May 29, 2019, which claims priority to European Patent Application No. 18176444.0, filed on Jun. 7, 2018, each of which is incorporated herein by reference in its entirety.

TECHNOLOGICAL FIELD

Embodiments of the present disclosure relate to rendering spatial audio scenes in sub-optimal conditions.

BACKGROUND

Multiple loudspeakers can be used to render spatial audio content so that a listener perceives the rendered spatial audio as emanating from one or more virtual sources at one or more particular locations or bearings. The location or bearing may be a location or bearing in three-dimensional space for volumetric or three-dimensional spatial audio, or a position or direction in a plane for two-dimensional spatial audio.

A "sound space" refers to the sound field created by an arrangement of sound sources in a space. A sound space may be defined in relation to recording sounds (a recorded sound space) and in relation to rendering sounds (a rendered sound space). A "sound scene" refers to a representation of the sound space as if listened to from a particular point of view within the sound space. A "sound object" refers to a sound source that may be located within the sound space irrespective of how it is encoded. It may for example by located by position or by direction. A recorded sound object represents sounds recorded at a particular microphone or from a particular location. A rendered sound object represents sounds rendered as if from a particular location.

For spatial audio, content rendered to a listener is controlled by the variable view point of the virtual user. In some examples, the orientation and/or location of the virtual user in the sound space may change with orientation and/or location of the user in a real space.

Different formats may be used to encode a spatially varying sound field as spatial audio content. For example, binaural encoding may be used for rendering a sound scene via headphones, a specific type of multi-channel encoding may be used for rendering a sound scene via a correspondingly specific configuration of loudspeakers (for example 5.1 surround sound), directional encoding may be used for rendering at least one sound source at a defined direction and positional encoding may be used for rendering at least one sound source at a defined position. An output audio signal can be converted from one format to another.

The output audio signal produced to render a sound scene needs to be matched to the arrangement of multiple loudspeakers used.

A particular format of spatial audio may require, for rendering, a particular arrangement of multiple loudspeakers or a particular environment or user position.

If the available audio conditions are not optimal, for example, if the set-up is sub-optimal compared to a recommended set-up, then the audio output will be sub-optimal in an uncontrolled way.

BRIEF SUMMARY

According to various, but not necessarily all, embodiments there is provided an apparatus comprising means for:

obtaining an indication of a position of at least one user in real space; mapping the position of the user in real space to a position of the user in a sound space; and controlling an output audio signal, for rendering a sound scene via multiple audio channels, to provide rendering of a first sub-set of sound sources via at least a first sub-set of the multiple audio output channels and rendering a second sub-set of sound sources via at least a second sub-set of the multiple audio output channels wherein an allocation of a plurality of sound sources to either the first sub-set of sound sources or the second sub-set of sound sources is dependent upon at least a position of the user in the sound space; wherein an allocation of the multiple audio output channels to either the first sub-set of the multiple audio output channels or the second sub-set of the multiple audio output channels is dependent upon available audio paths for the multiple audio output channels.

In some but not necessarily all examples, an audio path for an audio output channel is an available audio path if it is a direct audio path to the user.

In some but not necessarily all examples, an audio path for an audio output channel is an available audio path if it is a direct path to the user in real space from a loudspeaker or a direct path to the user in the sound space from a sound source or a virtual loudspeaker.

In some but not necessarily all examples, the allocation to the first sub-set of sound sources is an allocation to cause direct rendering and allocation of the second sub-set of sound sources is an allocation to cause indirect rendering. In some but not necessarily all examples, the sound sources for direct rendering and the sound sources for indirect rendering are identified based on the position of the user in the sound space.

In some but not necessarily all examples, an allocation of a plurality of sound sources to either the first sub-set or the second sub-set is dependent upon at least a position of the user in the sound space relative to a reference position in the sound space.

In some but not necessarily all examples, an allocation of a plurality of sound sources to either the first sub-set or the second sub-set is dependent upon at least a position of the user in the sound space relative to the plurality of sound sources.

In some but not necessarily all examples, the available audio paths for the multiple audio output channels are dependent upon at least a position of the user.

In some but not necessarily all examples, the allocation to the first sub-set of sound sources is an allocation to cause rendering of to the first sub-set of sound sources from a first set of transducers and the allocation of the second sub-set of sound sources is an allocation to cause rendering of second sub-set of sound sources from a second set of transducers, wherein each of the transducers in the first set of transducers are closer to the position of the user compared to any of the transducers in the second set of transducers.

In some but not necessarily all examples, there is a system comprising the apparatus and a loudspeaker comprising multiple transducers clustered around a reference position for rendering the sound scene via multiple audio channels, wherein the reference position is at most a first distance from the multiple transducers and wherein the reference position is a second distance from the position of the user in the real space, and wherein the first distance is less than the second distance. In some but not necessarily all examples, the multiple transducers clustered around the reference position face outwardly away from the reference position. In some but not necessarily all examples, available audio paths for the multiple audio output channels are dependent upon at least a position of the user relative to the reference position. In some but not necessarily all examples, the system comprises means for obtaining an indication of an orientation of the loudspeaker, wherein the available audio output paths for the multiple audio output channels are dependent upon the orientation of the loudspeaker in real space and the position of the user in real space.

According to various, but not necessarily all, embodiments there is provided a method comprising: obtaining an indication of a position of at least one user in real space; mapping the position of the user in real space to a position of the user in a sound space; and controlling an output audio signal, for rendering a sound scene via multiple audio channels, to provide rendering of a first sub-set of sound sources via at least a first sub-set of the multiple audio output channels and rendering a second sub-set of sound sources via at least a second sub-set of the multiple audio output channels, wherein an allocation of a plurality of sound sources to either the first sub-set of sound sources or the second sub-set of sound sources is dependent upon at least a position of the user in the sound space; wherein an allocation of the multiple audio output channels to either the first sub-set of the multiple audio output channels or the second sub-set of the multiple audio output channels is dependent upon available audio paths for the multiple audio output channels.

According to various, but not necessarily all, embodiments there is provided an apparatus comprising means for:
mapping a position of the user in real space to a position of the user in a sound space; allocating a plurality of sound sources to a first sub-set of sound sources or a second sub-set of sound sources is dependence upon at least a position of the user in the sound space;
allocating multiple audio output channels to a first sub-set of the multiple audio output channels or the second sub-set of the multiple audio output channels in dependence upon available audio paths for the multiple audio output channels; and
controlling an output audio signal, for rendering a sound scene via the multiple audio channels, to provide rendering of the first sub-set of sound sources via at least the first sub-set of the multiple audio output channels and rendering the second sub-set of sound sources via at least the second sub-set of the multiple audio output channels.

According to various, but not necessarily all, embodiments there is provided a computer program that when run on one or more processors causes:
mapping a position of the user in real space to a position of the user in a sound space; and
controlling an output audio signal, for rendering a sound scene via multiple audio channels, to provide rendering of a first sub-set of sound sources via at least a first sub-set of the multiple audio output channels and rendering a second sub-set of sound sources via at least a second sub-set of the multiple audio output channels,
wherein an allocation of a plurality of sound sources to either the first sub-set of sound sources or the second sub-set of sound sources is dependent upon at least a position of the user in the sound space;
wherein an allocation of the multiple audio output channels to either the first sub-set of the multiple audio output channels or the second sub-set of the multiple audio output channels is dependent upon available audio paths for the multiple audio output channels.

According to various, but not necessarily all, embodiments there is provided an apparatus comprising: at least one processor; and at least one memory including computer program code, the at least one memory and the computer program code configured to, with the at least one processor, cause the apparatus 100 at least to perform: mapping a position of the user in real space to a position of the user in a sound space; and controlling an output audio signal, for rendering a sound scene via multiple audio channels, to provide rendering of a first sub-set of sound sources via at least a first sub-set of the multiple audio output channels and rendering a second sub-set of sound sources via at least a second sub-set of the multiple audio output channels, wherein an allocation of a plurality of sound sources to either the first sub-set of sound sources or the second sub-set of sound sources is dependent upon at least a position of the user in the sound space; wherein an allocation of the multiple audio output channels to either the first sub-set of the multiple audio output channels or the second sub-set of the multiple audio output channels is dependent upon available audio paths for the multiple audio output channels.

In some examples, an available audio path is a physical path by which an audio signal can reach the at least one user in the real space. In some examples, the allocation can be based on existence of an available audio path or paths and/or based on a length of an available audio path or paths. In some examples, the available audio paths are dependent upon at least a position in the real space of the at least one user.

According to various, but not necessarily all, embodiments there is provided examples as claimed in the appended claims.

BRIEF DESCRIPTION

Some example embodiments will now be described with reference to the accompanying drawings in which.

DEFINITIONS

Figure 1:
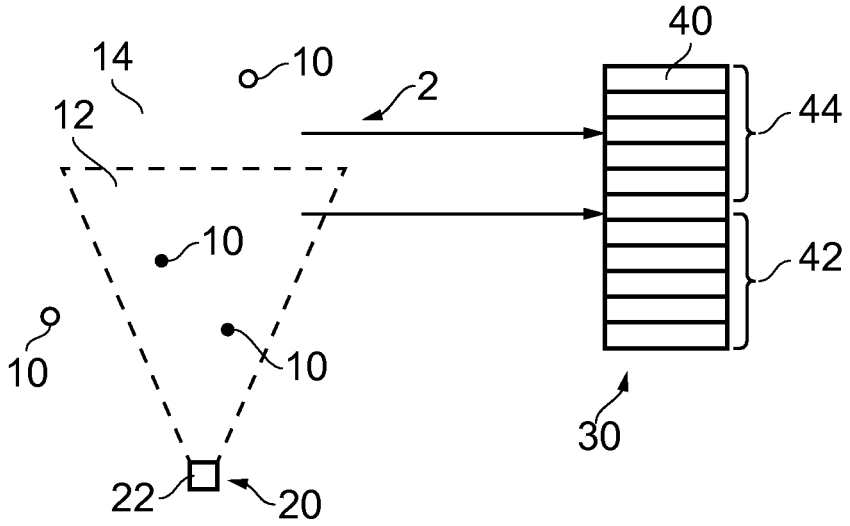
FIG. 1 shows an example embodiment of the subject matter described herein.

A "sound space" refers to the sound field created by an arrangement of sound sources in a space. A sound space may be defined in relation to recording sounds (a recorded sound space) and in relation to rendering sounds (a rendered sound space).

A "sound scene" refers to a representation of the sound space as if listened to from a particular point of view within the sound space.

A "sound object" refers to sound source that may be located within the sound space irrespective of how it is encoded. It may for example be located by position or by direction. A recorded sound object represents sounds recorded at a particular microphone or from a particular location. A rendered sound object represents sounds rendered as if from a particular location.

An indication of a position is the position or some information that indicates the position.

A position in real space is a location in two or three dimensions in the real world.

A user is an animal, for example a person, using the system or apparatus. They are the listener to the loudspeaker(s).

An audio output signal is a signal that can control rendering at a loudspeaker(s). The loudspeaker may be comprised in a headset or other apparatus.

DETAILED DESCRIPTION

Multiple loudspeakers or head-tracked headphones can be used to render spatial audio content so that a listener perceives the rendered spatial audio as emanating from one or more virtual sources at one or more locations or bearings. The location or bearing may be a location or bearing in three-dimensional space for volumetric or three-dimensional spatial audio, or a location or bearing in a plane for two-dimensional spatial audio.

A sound space is an arrangement of sound sources in a space that creates a sound field. A sound space may, for example, be defined in relation to recording sounds (a recorded sound space) and in relation to rendering sounds (a rendered sound space). An audio scene is a representation of the sound space as if listened to from a particular point of view within the sound space. A point of view is determined by an orientation of a virtual user and also possibly a location of a virtual user. A sound object is a sound source that may be located within the sound space irrespective of how it is encoded. It may for example be positioned by location or by bearing. A recorded sound object represents sounds recorded at a particular microphone or location. A rendered sound object represents sounds rendered as if from a particular location or bearing.

Different formats may be used to encode a spatially varying sound field as spatial audio content. For example, binaural encoding may be used for rendering an audio scene via headphones, a specific type of multi-channel encoding may be used for rendering an audio scene via a correspondingly specific configuration of loudspeakers (for example 5.1 or 7.1 surround sound), directional encoding may be used for rendering at least one sound source at a defined bearing and positional encoding may be used for rendering at least one sound source at a defined location.

An output audio signal used to control rendering can be converted from one format to another.

If the available audio conditions are not optimal, for example, if the set-up is sub-optimal compared to a recommended set-up, then the audio output will be sub-optimal in an uncontrolled way.

It would be desirable to control the audio output when a set-up is sub-optimal.

A set-up will be sub-optimal, for example, when the audio paths to a user are sub-optimal.

This may, for example, occur because of a local environment of a user or of a loudspeaker or loudspeakers. The user may be at a sub-optimal location and/or orientation for a current arrangement of loudspeakers. Alternatively, the arrangement of loudspeakers may be sub-optimal for a location and/or orientation of a user.

In some examples, the user may move so that the user or an object obstructs a direct path from a loudspeaker to the user.

In some examples, a loudspeaker may fail, be misplaced or be moved so that the intended direct or indirect path to the user is no longer available. Some loudspeaker systems, for example, have up-ward firing loudspeakers so that sound follows an indirect path, bouncing off a ceiling before reaching a user.

In some examples, an optimal arrangement of loudspeakers may not be available and the user may deliberately use a sub-optimal arrangement.

FIG. 1 illustrates an example of a sound space 2 comprising sound sources 10 and the allocation of sound sources 10 to audio output channels 40.

The sound space 2 comprises a plurality of sound sources 10. A (virtual) user 20 in the sound space 2 has a position 22.

The FIG. 1 illustrates the allocation of sound sources 10 to audio output channels 40. Sound sources 10 are allocated to sub-sets 12, 14 and then the sub-sets 12, 14 of sound sources 10 are allocated to different sub-sets 42, 44 of audio output channels 40.

An audio output signal 30 is produced. This audio output signal 30 is for rendering a sound scene via multiple audio channels 40. The audio output signal 30 controls rendering of the first sub-set 12 of the sound sources 10 via at least the first sub-set 42 of the multiple audio output channels 40 and rendering the second sub-set 14 of sound sources 10 via at least the second sub-set 44 of the multiple audio output channels 40.

In some examples, but not necessarily all examples, the audio output signal 30 controls rendering of only the first sub-set 12 of the sound sources 10 via only the first sub-set 42 of the multiple audio output channels 40 and rendering of only the second sub-set 14 of sound sources 10 via only the second sub-set 44 of the multiple audio output channels 40.

The allocation of sound sources 10 to sub-sets 12, 14 is dependent upon at least the position 22 of the user 20 in the sound space 2. Position in this sense may, for example, mean a location or a bearing (orientation) or a combination of location and bearing.

Allocation of the sub-sets 12, 14 to audio output channels 40 is dependent upon available audio paths for the multiple audio output channels 40.

In some, but not necessarily all, examples, the multiple audio output channels 40 are virtual audio output channels. A virtual audio output channel may, for example, represent a virtual loudspeaker or it may, for example, represent a virtual sound source (a sound object).

In some, but not necessarily all, examples, the audio output channels 40 may be real audio output channels. A real audio output channel may, for example, represent a real loudspeaker output, for example, the output from a particular transducer of a particular loudspeaker.

The sound source 10 or an audio output channel (virtual or real) 40 can be described as "direct" or "indirect". Direct means that there is a direct primary path to the user. The audio appears to the user to arrive from a particular direction and there is little reverberation arising from reflections and multi-path.

Indirect means that there is no one primary path to the user. There is reverberation arising from reflections and multi-path. The audio may not seem to have arrived from a particular direction or may seem to have arrived from a number of directions or from a diffuse area or volume.

An available audio path is a physical path by which an audio signal (pressure wave) can reach the user at that time.

A direct audio path is an audio path in which the audio signal travels directly from the source to the user. An indirect audio path is an audio path in which the audio signal travels indirectly from the source to the user. This may, for example, arise or be achieved by having loudspeakers that are at a distance from the user compared to other objects that reflect sound waves, having loudspeakers that do not have a line of sight to the user or having loudspeakers arranged to bounce audio off walls or ceilings to the user.

In some examples, the allocation of sub-sets 12, 14 to audio output channels 40 is dependent upon available direct audio paths for the multiple audio output channels. A direct path may, for example, be a direct path to the user in real space from a loudspeaker or may be a direct path to the user in the sound space from a sound source or virtual loudspeaker. A virtual loudspeaker is a representation of a loudspeaker in the sound space.

In some examples, it may be desirable to sense the real space by, for example, performing an impulse response measurement to determine whether or not there is a direct path to the user in the real space.

If a sound source 10 is direct, it may be desirable to allocate that sound source 10 to a sub-set 12 of sound objects 10 for direct sound sources and then allocate that sub-set 10 of direct sound sources to direct audio output channels (real or virtual) which are a sub-set 42 of the audio output channels 40.

If a sound source is indirect, it may be desirable to allocate that sound source 10 to a sub-set 14 of sound objects 10 for indirect sound sources and then allocate that sub-set 14 of indirect sound sources to indirect audio output channels (real or virtual) which are a sub-set 44 of the audio output channels 40.

Figure 2:
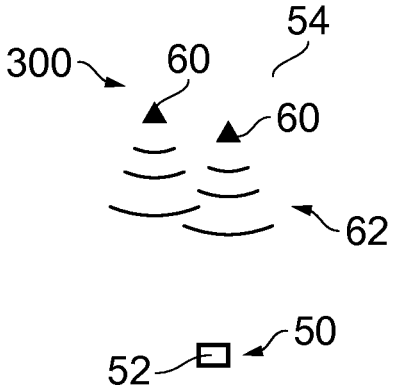
FIG. 2 shows another example embodiment of the subject matter described herein.
Figure 3:
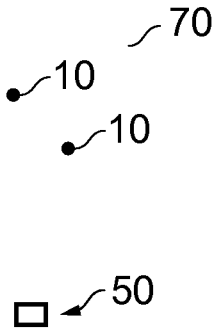
FIG. 3 shows an example embodiment of the subject matter described herein.

FIG. 2 illustrates an example of a user 50 at a position 52 in a real space 54. Loudspeaker transducers 60 of a loudspeaker system 300 produce an audio field 62 which produces a rendered sound scene 70, for the user 50 as illustrated in FIG. 3. In this sound scene 70, the user 50 perceives the sound sources 10 in the first set 12 to be rendered directly that is from a particular position in the sound scene 70 that corresponds to their position in the sound space 2. However, the sound sources 10 in the second set 14 (not illustrated in FIG. 3) are rendered indirectly to the user and do not appear to be rendered from a particular position.

If the user changes his position 52 then the position of the virtual user 20 also changes. This will result in a change in the content of the first set 12 and the second set 14 of sound sources 10 which, in turn, will result in a different output audio signal 30, a different rendered sound field 62 and a different rendered audio scene 70. The user 50 is therefore able to appreciate certain aspects of spatial audio content comprising sound sources 10 without necessarily having an optimal or specifically prepared arrangement of loudspeaker transducers 60. The user 50 experiences some limited aspects of spatial audio without the full spatial audio scene being rendered to the user 50.

Figure 4:
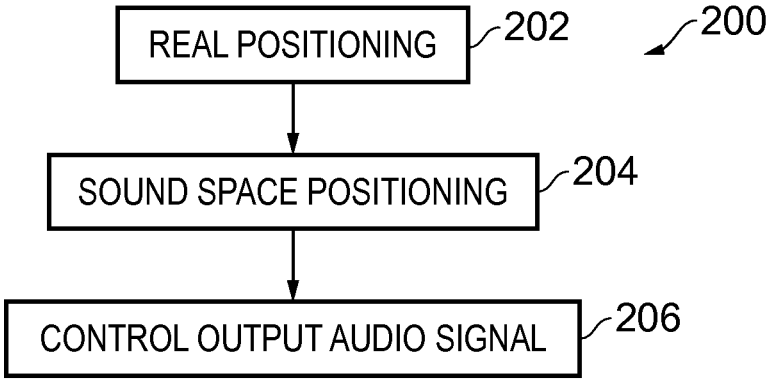
FIG. 4 shows another example embodiment of the subject matter described herein.

FIG. 4 illustrates a method 200 comprising:

at block 202, obtaining an indication of a position 52 of at least one user 50 in real space 54;

at block 204, mapping the position 52 of the user 50 in real space 54 to a position 22 of the user 20 in a sound space 2;

at block 206 controlling an output audio signal 30, for rendering a sound scene via multiple audio channels 40, to provide rendering of a first sub-set 12 of the sound sources 10 via at least a first sub-set 42 of the multiple audio output channels 40 and rendering a second sub-set 14 of sound sources 10 via at least a second sub-set 44 of the multiple audio output channels 40.

The allocation of the multiple audio output channels 40 to either the first sub-set 42 of the multiple audio output channels 40 or the second sub-set 44 of the multiple audio output channels 40 is dependent upon available audio paths for the multiple audio output channels 40.

In some but not necessarily all examples, the first sub-set 12 of sound sources 10 is for direct rendering and the second sub-set 14 of sound sources 10 is for indirect rendering.

In some but not necessarily all examples, the first sub-set 12 of sound sources 10 is non-overlapping with the second sub-set 12 of sound sources 10. For example, a sound source 10 may be allocated to either of first sub-set 12 or the second set 14 of sound sources 10.

In some but not necessarily all examples, the allocation of a plurality of sound sources 10 to either the first sub-set 12 of sound sources 10 or the second sub-set 14 of sound sources 10 is dependent upon at least a position 22 of the user 20 in the sound space 2.

For example, the allocation of sound sources 10 to the sub-sets 12, 14 may be dependent upon a position of the user 20 in the sound space 2 relative to a reference position in the sound space. The reference position may, for example, be a position in the sound space 2 that corresponds to a position of a or a cluster of loudspeaker transducers 60 in the real space 54. A first vector between the position 22 of the user 20 in the sound space 2 and the reference position may be used to separate sound sources into the first and second sub-sets 12,14.

The allocation of sound sources 10 to the sub-set 12, 14 may be dependent upon a position 22 of the user 20 in the sound space 2 relative to the plurality of sound sources 10.

For example, sound sources 10 that within a defined distance of the first vector or within a sector defined by the first vector may be allocated to the first sub-set 12 and the remaining or some of the remaining sound sources allocated to the second sub-et 14.

For example, sound sources 10 that are within a defined distance of the first vector or within a sector defined by the first vector and that are within a defined distance of the reference position and/or the user position 22 may be allocated to the first sub-set 12 and the remaining or some of the remaining sound sources allocated to the second sub-set 14.

For example, a second vector may be defined as orthogonal to the first vector and passing through the reference position. The sound sources that are between the second vector and the user position 22 may be allocated to the first sub-set 12 and the remaining or some of the remaining sound sources 10 allocated to the second sub-set 14.

In some but not necessarily all examples, the allocation of the multiple audio output channels 40 to either the first sub-set 42 of the multiple audio output channels 40 or the second sub-set 44 of the multiple audio output channels 40 is dependent upon available audio paths for the multiple audio output channels 40.

In some but not necessarily all examples, the first sub-set 42 of the multiple audio output channels 40 is for direct rendering and the second sub-set 42 of the multiple audio output channels 40 is for indirect rendering.

In some but not necessarily all examples, the first sub-set 42 of the multiple audio output channels 40 is non-overlapping with the second sub-set 44 of the multiple audio output channels 40. For example, a sound source may be allocated to either of first sub-set 42 or the second set 44 of the multiple audio output channels 40.

For example, the allocation can be based on existence of an available audio path or paths and/or based on a length of an available audio path or paths.

This may, for example, occur because of a local environment to a user or to a loudspeaker or loudspeakers. The user may be at a sub-optimal location and/or orientation for a current arrangement of loudspeakers. Alternatively, the arrangement of loudspeakers may be sub-optimal for a location and/or orientation of a user. In some examples, the user may move so that an object obstructs a direct path from a loudspeaker to the user. In some examples, a loudspeaker may fail, be misplaced or be moved so that a direct or indirect path to the user is no longer available. In some examples, the available arrangement of loudspeakers may be sub-optimal.

The available audio paths for the multiple audio output channels can therefore be dependent upon at least a position of the user.

The allocation of sound sources 10 to the sub-set 42, 44 of the multiple audio output channels 40 may be dependent upon a position of the user 20 in the sound space 2 relative to a reference position in the sound space. The reference position may, for example, be a position in the sound space 2 that corresponds to a position of one or more loudspeaker transducers 60 in the real space 54.

The allocation of sound sources 10 to the sub-set 42, 44 of the multiple audio output channels 40 may be dependent upon a position 22 of the user 20 in the sound space relative to the plurality of sound sources 10.

For example, sound sources 10 that within a defined distance of a loudspeaker transducer 60 directed at the user 50 may be allocated to the first sub-set 42 and the remaining or some of the remaining sound sources 10 allocated to the second sub-et 44.

For example, sound sources 10 that within a defined distance of a loudspeaker transducer 60 directed at the user 50 may be allocated to the first sub-set 42 and the remaining or some of the remaining sound sources 10 allocated to the second sub-et 44.

For example the first set 42 of audio output channels 40 may be used for transducers 60 closest to the position 52 of the user 50 and the remaining or some of the remaining transducers 50 used for at least some of the remaining audio output channels 40 allocated to the second sub-set 44. Thus the second set 44 of audio output channels 40 are for transducers furthest from the position of the user.

Figure 5:
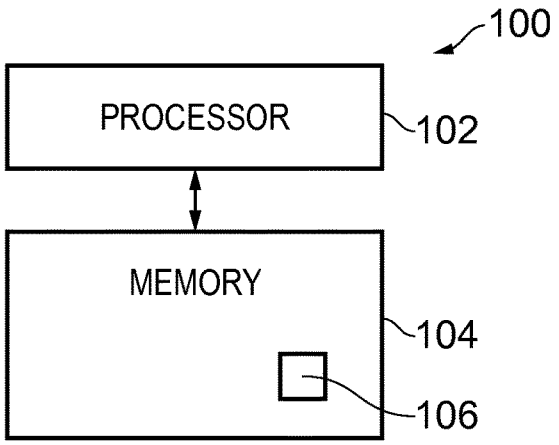
FIG. 5 shows an example embodiment of the subject matter described herein.

FIG. 5 illustrates an example of an apparatus 100 comprising means for:

obtaining an indication of a position 52 of at least one user 50 in real space 54;

mapping the position 52 of the user 50 in real space 54 to a position 22 of the user 20 in a sound space 2; and controlling an output audio signal 30, for rendering a sound scene 70 via multiple audio channels 40, to provide rendering of a first sub-set 12 of sound sources 10 via at least a first sub-set 42 of the multiple audio output channels 40 and rendering a second sub-set 14 of sound sources 10 via at least a second sub-set 44 of the multiple audio output channels 40, wherein an allocation of a plurality of sound sources 10 to either the first sub-set 12 of sound sources 10 or the second sub-set 14 of sound sources is dependent upon at least a position 22 of the user 20 in the sound space 2; wherein an allocation of the multiple audio output channels 40 to either the first set-set 42 of the multiple audio output channels 40 or the second sub-set 44 of the multiple audio output channels 40 is dependent upon available audio paths for the multiple audio output channels 40.

FIG. 5 illustrates an example of a controller or other apparatus 100. Implementation of a controller 100 may be as controller circuitry. The controller 100 may be implemented in hardware alone, have certain aspects in software including firmware alone or can be a combination of hardware and software (including firmware).

As illustrated in FIG. 5 the controller 100 may be implemented using instructions that enable hardware functionality, for example, by using executable instructions of a computer program 106 in a general-purpose or special-purpose processor 102 that may be stored on a computer readable storage medium (disk, memory etc) to be executed by such a processor 102.

The processor 102 is configured to read from and write to the memory 104. The processor 102 may also comprise an output interface via which data and/or commands are output by the processor 102 and an input interface via which data and/or commands are input to the processor 102.

The memory 104 stores a computer program 106 comprising computer program instructions (computer program code) that controls the operation of the apparatus 100 when loaded into the processor 102. The computer program instructions, of the computer program 106, provide the logic and routines that enables the apparatus 100 to perform the methods illustrated in FIG. 4. The processor 102 by reading the memory 104 is able to load and execute the computer program 106.

The apparatus 100 therefore comprises:

at least one processor 102; and at least one memory 104 including computer program code the at least one memory 104 and the computer program code configured to, with the at least one processor 102, cause the apparatus 100 at least to perform:

obtaining an indication of a position 52 of at least one user 50 in real space 54;

mapping the position 52 of the user 50 in real space 54 to a position 22 of the user 20 in a sound space 2;

controlling an output audio signal 30, for rendering a sound scene via multiple audio channels 40, to provide rendering of a first sub-set 12 of the sound sources 10 via at least a first sub-set 42 of the multiple audio output channels 40 and rendering a second sub-set 14 of sound sources 10 via at least a second sub-set 44 of the multiple audio output channels 40.

The allocation of the multiple audio output channels 40 to either the first sub-set 42 of the multiple audio output channels or the second sub-set 44 of the multiple audio output channels is dependent upon available audio paths for the multiple audio output channels 40.

Figure 6:
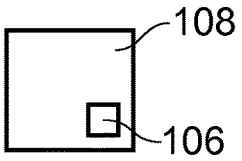
FIG. 6 shows another example embodiment of the subject matter described herein.

As illustrated in FIG. 6, the computer program 106 may arrive at the apparatus 100 via any suitable delivery mechanism 108. The delivery mechanism 108 may be, for example, a machine readable medium, a computer-readable medium, a non-transitory computer-readable storage medium, a computer program product, a memory device, a record medium such as a Compact Disc Read-Only Memory (CD-ROM) or a Digital Versatile Disc (DVD) or a solid state memory, an article of manufacture that comprises or tangibly embodies the computer program 106. The delivery mechanism may be a signal configured to reliably transfer the computer program 106. The apparatus 100 may propagate or transmit the computer program 106 as a computer data signal.

Computer program instructions for causing an apparatus to perform at least the following or for performing at least the following:

mapping a position 52 of the user 50 in real space 54 to a position 22 of the user 20 in a sound space 2; and controlling an output audio signal 30, for rendering a sound scene via multiple audio channels 40, to provide rendering of a first sub-set 12 of the sound sources 10 via at least a first sub-set 42 of the multiple audio output channels 40 and rendering a second sub-set 14 of sound sources 10 via at least a second sub-set 44 of the multiple audio output channels 40.

The computer program instructions may be comprised in a computer program, a non-transitory computer readable medium, a computer program product, a machine readable medium. In some but not necessarily all examples, the computer program instructions may be distributed over more than one computer program.

Although the memory 104 is illustrated as a single component/circuitry it may be implemented as one or more separate components/circuitry some or all of which may be integrated/removable and/or may provide permanent/semi-permanent/dynamic/cached storage.

Although the processor 102 is illustrated as a single component/circuitry it may be implemented as one or more separate components/circuitry some or all of which may be integrated/removable. The processor 102 may be a single core or multi-core processor.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' may refer to one or more or all of the following:

(a) hardware-only circuitry implementations (such as implementations in only analog and/or digital circuitry) and (b) combinations of hardware circuits and software, such as (as applicable):

(i) a combination of analog and/or digital hardware circuit(s) with software/firmware and (ii) any portions of hardware processor(s) with software (including digital signal processor(s)), software, and memory(ies) that work together to cause an apparatus, such as a mobile phone or server, to perform various functions and (c) hardware circuit(s) and or processor(s), such as a microprocessor(s) or a portion of a microprocessor(s), that requires software (e.g. firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor and its (or their) accompanying software and/or firmware. The term circuitry also covers, for example and if applicable to the particular claim element, a baseband integrated circuit for a mobile device or a similar integrated circuit in a server, a cellular network device, or other computing or network device.

The blocks illustrated in the FIG. 4 may represent steps in a method and/or sections of code in the computer program 106. The illustration of a particular order to the blocks does not necessarily imply that there is a required or preferred order for the blocks and the order and arrangement of the block may be varied. Furthermore, it may be possible for some blocks to be omitted.

Figure 7A:
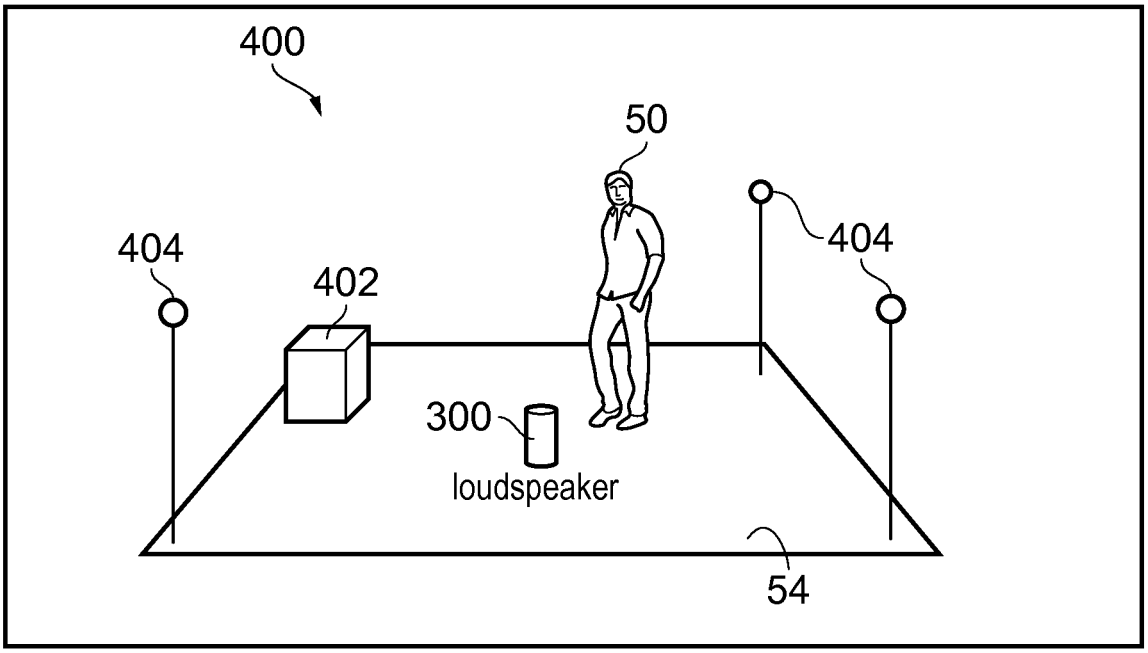
FIG. 7A shows an example embodiment of the subject matter described herein.

FIG. 7A illustrates a system 400 comprising: server 402; a positioning system 404, and a loudspeaker system 300 comprising multiple transducers.

In some examples, the server 402 is configured to operate as the apparatus 100. In other examples, the loudspeaker system 300 is configured to operate as the apparatus 100.

The server 402 is configured to provide spatial audio content to the apparatus 10.

The apparatus 100 is configured to provide the output audio signal 30, as described above. The output audio signal 30 is used at the loudspeaker system 300 to render a sound scene via multiple audio channels 40. A first sub-set 12 of the sound sources 10 are rendered via at least a first sub-set 42 of the multiple audio output channels 40. A second sub-set 14 of sound sources 10 are rendered via the second sub-set 44 of the multiple audio output channels 40. In some but not necessarily all examples, each of the multiple audio output channels 40 may be associated with a particular loudspeaker transducer.

The positioning system 404 is configured to position the user 50 in the real space 54. In some examples it may also be configured to position the loudspeaker system 300.

There are several additional positioning systems 404 usable for tracking a position of the loudspeaker system 300 and/or the user 50.

A Kinect™ type of sensor may be positioned on the edge of the listening area, such a sensor projects a pattern using infrared and detects the reflected pattern using stereoscopic cameras. Augmented reality glasses, for example Hololens™ use tracking to determine a user's head position and orientation. Apple ARKit or Google ARCore can provide tracking on a mobile phone. Sensors can be used similar to those used in an augmented/virtual reality head mounted displays such as the Lighthouse tracking used in the HTC Vive. Sound source localization using several microphones may be used. Camera based object tracking can be used, for example computer vision using deep convolutional neural networks. Manual positioning may be used, for example, the user 10 may input the position of the loudspeaker system 300 manually, using a UI on a mobile phone for example.

A position of a user 50 may be tracked by tracking a position of a portable electronic device carried by the user 50 using indoor positioning means or using satellite positioning, for example, Global Navigation Satellite System.

The positioning of the user 50 can be performed by the loudspeaker system 300. For example, the loudspeaker system 300 can contain a camera. The camera can be used to determine user head position and orientation. Based on the user head position and orientation and knowing the camera parameters such as zoom level, a distance estimate of the user head from the speaker may be obtained.

Figure 7B:
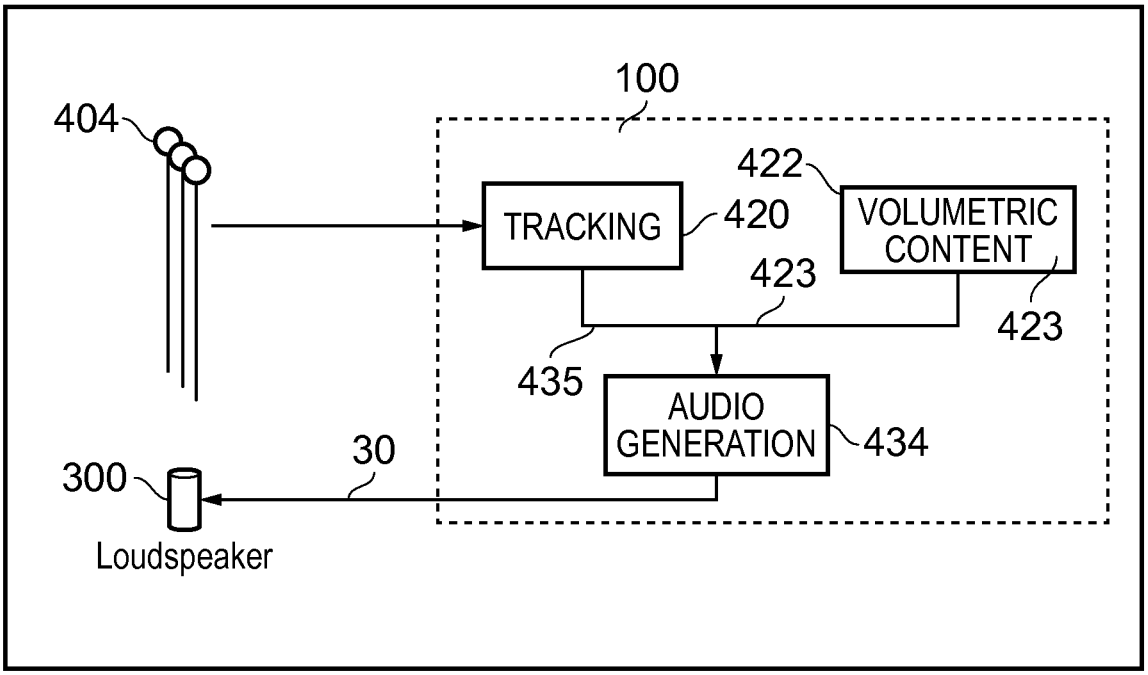
FIG. 7B shows another example embodiment of the subject matter described herein.

FIG. 7B illustrates an example of the apparatus 100. In this case the apparatus 100 is the server 402.

In this example, the apparatus 100 comprises a tracking module 420, a database module 422 for storing spatial audio content 423 and a synthesis module 434 for processing the spatial audio content 423 and the positional information 435.

The synthesis module 434 is configured to obtain at least an indication 435 of a position 52 of at least one user 50 in real space 54 and then map the position 52 of the user 50 in real space 54 to a position 22 of the user 20 in a sound space 2.

The synthesis module 434 is configured to control an output audio signal 30, for rendering a sound scene 70 via multiple audio output channels 40 of the loudspeaker system 300.

The loudspeaker system 300 renders a first sub-set 12 of the sound sources 10 via at least a first sub-set 42 of loudspeaker transducers 60 (audio output channels 40) and renders a second sub-set 14 of sound sources 10 via at least a second sub-set 44 of loudspeaker transducers 60 (audio output channels 40).

Figure 8A:
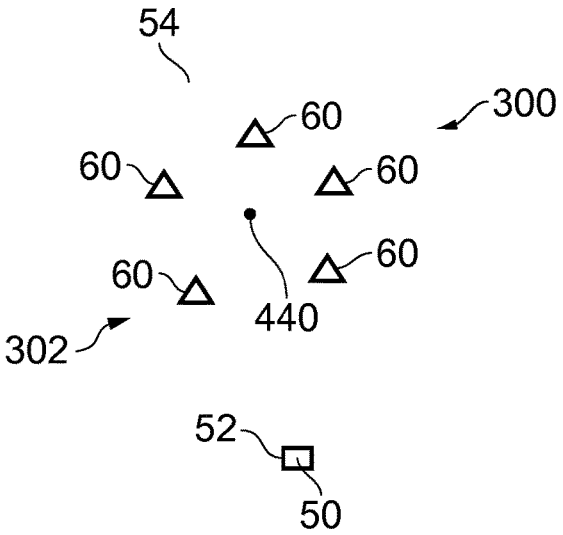
FIG. 8A shows an example embodiment of the subject matter described herein.
Figure 8B:
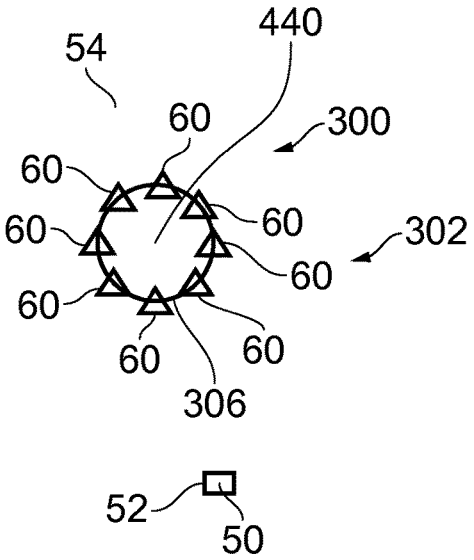
FIG. 8B shows another example embodiment of the subject matter described herein.

FIGS. 8A and 8B illustrate examples in which the loudspeaker system 300 is a cluster 302 of loudspeaker transducers 60.

The multiple transducers 60 are configured to render the sound scene 70 via multiple audio output channels 40.

In this example the size (e.g. diameter) of the cluster 302 is much less than a distance from the cluster 302 to the user 50. The multiple transducers 60 are clustered relative to a reference position 440. The reference position may, for example, be a center of the cluster 302. The reference position 440 is closer to the multiple transducers 60 than it is to the position 52 of the user 50 in the real space 54.

The available audio paths for the multiple audio output channels 40 are dependent upon at least a position of the user relative to the reference position.

For example some transducers 60 have a line-of-sight to the user 50 and have audio paths that are available for direct sound sources (not available for indirect sound sources) and can be allocated to the direct audio output channels 42. The identity of these transducers 60 depends upon a relative position of the user 50 to the loudspeaker system 300 and is therefore dependent upon both the orientation of the loudspeaker system 300 and the position (location and orientation) of the user 50.

For example, some transducers 60 do not have a line-of-sight to the user 50 and have audio paths that are available for indirect sound sources (not available for direct sound sources) and can be allocated to the indirect audio output channels 44. The identity of these transducers 60 depends upon relative position of the user 50 to the loudspeaker system 300 and is therefore dependent upon both the orientation of the loudspeaker system 300 and the position (location and orientation) of the user 50.

It may not be necessary to determine a line-of-sight status for each transducer.

The determination of whether there is, or is not, a line-of-sight may be based upon a minimum level of confidence or probability, rather than certainty.

The positioning system 404 is configured to obtain an indication of a relative orientation of the user 50 to the cluster 302 of loudspeaker transducers 60. The available audio paths for the multiple audio output channels 40 are dependent upon the orientation of the loudspeaker system 300 in real space and the position of the user 50 in real space.

In the example of FIG. 8A—, but not necessarily all examples, the multiple loudspeaker transducers 60 clustered around the reference position 440, face in arbitrary directions. In other examples, the multiple transducers clustered around the reference position can face outwardly away from the reference position 440.

In the example of FIG. 8A, but not necessarily all examples, the multiple loudspeaker transducers 60 clustered around the reference position 440 are independent or at least some can be moved relative to others. In other examples, the multiple transducers clustered can have a fixed arrangement.

The loudspeaker system 300 illustrated in FIG. 8B is different to that illustrated in FIG. 8A in that the cluster 302 of loudspeaker transducers 60 in FIG. 8B are a fixed arrangement. The loudspeaker transducers 60 are supported on an exterior of a common housing 306 so that each loudspeaker transducers 60 is configured to provide an output away from the housing 306. The multiple transducers clustered around the reference position 440, face outwardly away from the reference position 440.

The housing 306 allows the multiple transducers 60 to be moved and oriented as a single unit.

Figure 9:
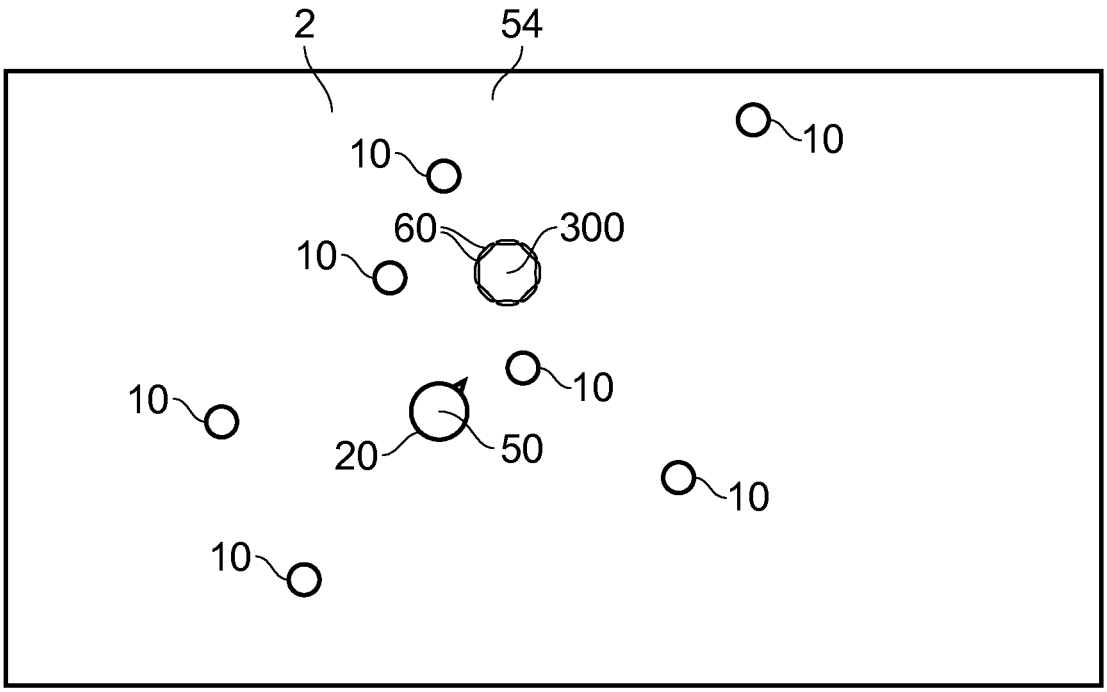
FIG. 9 shows an example embodiment of the subject matter described herein.

FIG. 9 illustrates an example in which a user 50 has placed a loudspeaker system 300 in real space 54, where the real space 54 has a corresponding sound space 2, comprising the virtual user 20 and several audio objects 10, mapped to it. For ease of illustration, the FIG. 9 illustrates simultaneously both the sound space 2 comprising the sound objects 10 and virtual user 20 and the real space 54 comprising the user 50 and the loudspeaker system 300. The figure thus shows how the sound space 2 and the real space 54 correspond spatially.

The loudspeaker system 300 is similar to the loudspeaker system illustrated in FIG. 8B. The loudspeaker system 300, in this example but not necessarily all examples, is an array of loudspeaker transducers 60 arranged in a circle around a portable housing. In this example, there are eight transducers 60. The user 50 has placed the portable loudspeaker system 300 in a real space 54 that has a corresponding audio space 2 comprising several sound sources 10, mapped to it. The user 50 is also in the same space 54.

Figure 10:
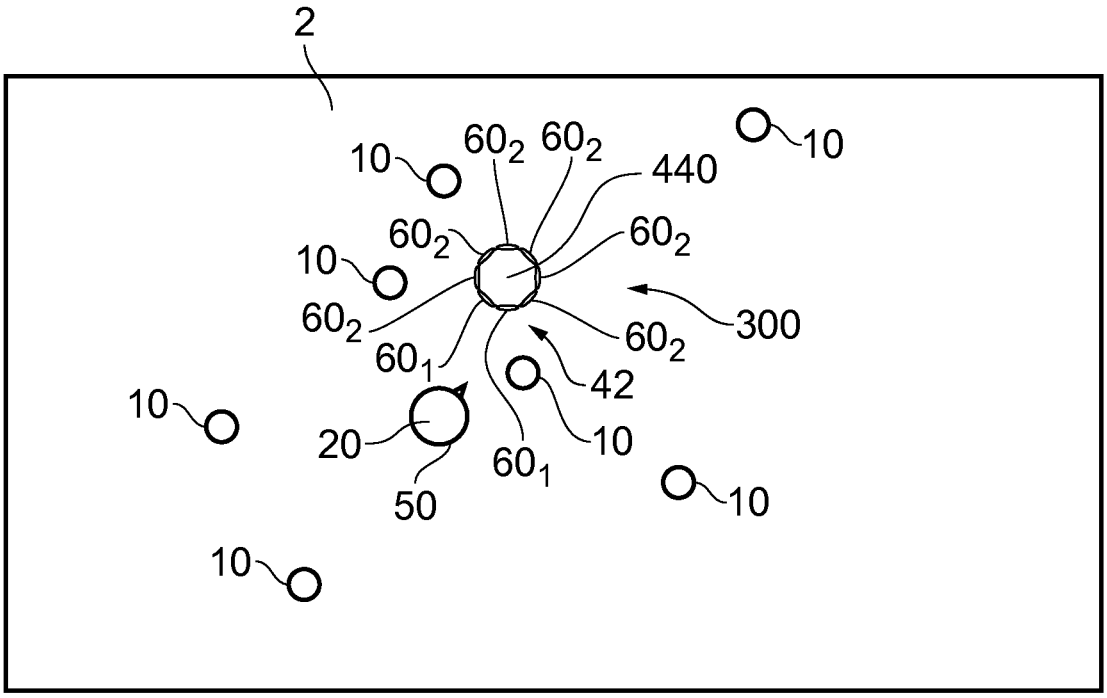
FIG. 10 shows another example embodiment of the subject matter described herein.

FIG. 10 illustrates that the loudspeaker transducers 60 of the loudspeaker system 300 may be logically divided into a first set 601 that corresponds to the first set 42 of audio output channels 40 and a second set 602 that corresponds to the second set 44 of audio output channels 40 (and, in some examples, more sets 60*i* that each correspond to one or more sets of audio output channels 40). In this example the audio output channels 40 are physical channels each of which is associated with a different one of the loudspeaker transducers 60.

The allocation of sound sources 10 to the sub-sets 12, 14 is dependent upon a position of the user 20 in the sound space 2 relative to a reference position 440 in the sound space 2. The reference position 440 may, for example, be a position in the sound space 2 that corresponds to a position of the loudspeaker system 300 in the real space 54.

The N loudspeaker transducers 601 that are closest to the user 50 are selected as the first sub-set 42 of output audio channels 40 for rendering a direct sub-set 12 of sound sources 10 and some or all of the other loudspeaker transducers 602 are selected as the second sub-set 44 of output audio channels 40 for rendering for rendering an indirect set 14 of sound sources 10. In this example N=2 but other values are possible.

The first sub-set 42 of the multiple audio output channels 40 (the 'direct' loudspeaker transducers 601) is for direct rendering and the second sub-set 44 of the multiple audio output channels 40 (the 'indirect' loudspeaker transducers 602) is for indirect rendering. The audio from the 'indirect' loudspeaker transducers 602 will be heard as more reverberant than the audio from the 'direct' loudspeaker transducers 601 due to the user hearing the audio through wall reflections etc.

In this example, the apparatus 100 comprises means for: obtaining an indication of an orientation of a loudspeaker system 300, comprising multiple transducers 60 clustered around a reference position 440, in real space 54; obtaining an indication of a variable position of at least one user 50 in real space 54; and controlling an output audio signal 30, for rendering a sound scene 70 by the loudspeaker system 300, the sound scene 70 being determined in dependence upon the orientation of the loudspeaker system 300 in real space and the variable position of the user 50 in real space.

Figure 11:
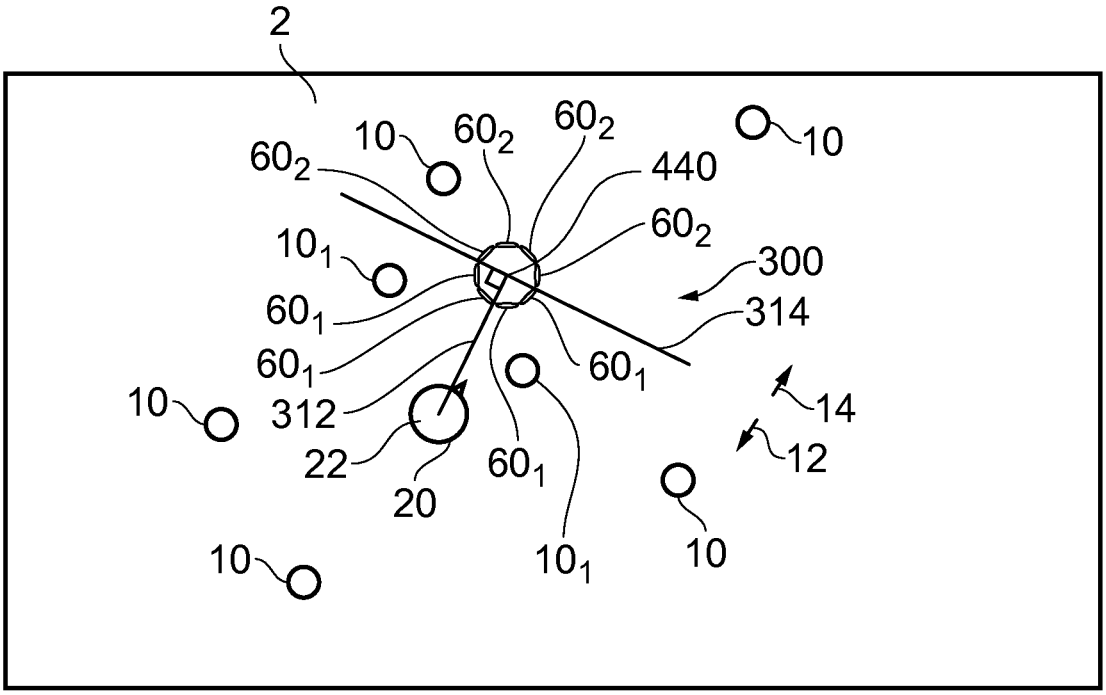
FIG. 11 shows an example embodiment of the subject matter described herein.

FIG. 11 is similar to FIG. 10 except that the selection of sound sources 10 for the first sub set 12 and the second sub-set 14 is different. The selection of loudspeaker transducers 60 for the first sub-set 42 of output audio channels 40 can also be different.

A first vector 312 between the position 22 of the user 20 in the sound space 2 and the reference position 440 may be used to separate sound sources 10 into the first and second sub-sets 12,14. Sound sources 10 can be allocated to the first sub-set 12 using a rule based on the first vector 312.

For example, sound sources 10 that within a defined distance of the first vector 312 or within a sector defined by the first vector 312 may be allocated to the first sub-set 12 and the remaining or some of the remaining sound sources allocated to the second sub-set 14.

For example, sound sources 10 that within a defined distance of the first vector or within a sector defined by the first vector 312 and that are within a defined distance of the reference position and/or the user position 22 may be allocated to the first sub-set 12 and the remaining or some of the remaining sound sources 10 allocated to the second sub-et 14.

For example, a second vector 314 may be defined as orthogonal to the first vector and passing through the reference position 440 at the loudspeaker system 300. Sound sources 10 can be allocated to the first sub-set 12 using a rule based on the second vector 314.

For example, the sound sources 101 that are between the second vector 314 and a threshold line (not illustrated), parallel to the second vector 314 and through the user position 22, may be allocated to the first sub-set 12 and the remaining or some of the remaining sound sources 10 allocated to the second sub-et 14.

Different rules may be used for allocating sound sources to the first sub-set 12 and second sub-set 14. For example, the threshold line may be alternatively positioned, or may form another shape such as a segment or curve.

The sound sources 10 of the first sub-set 12 may also need to be within a threshold distance of the user position 22 and/or the reference position 440.

In this example, the second vector 314 may also define which loudspeaker transducers 60 form the first sub-set 42 of output audio channels 40. For example, those loudspeaker transducers 60 between the first vector 314 and the user 20 are used as the first sub-set 42 of output audio channels 40, in this example.

Figure 12:
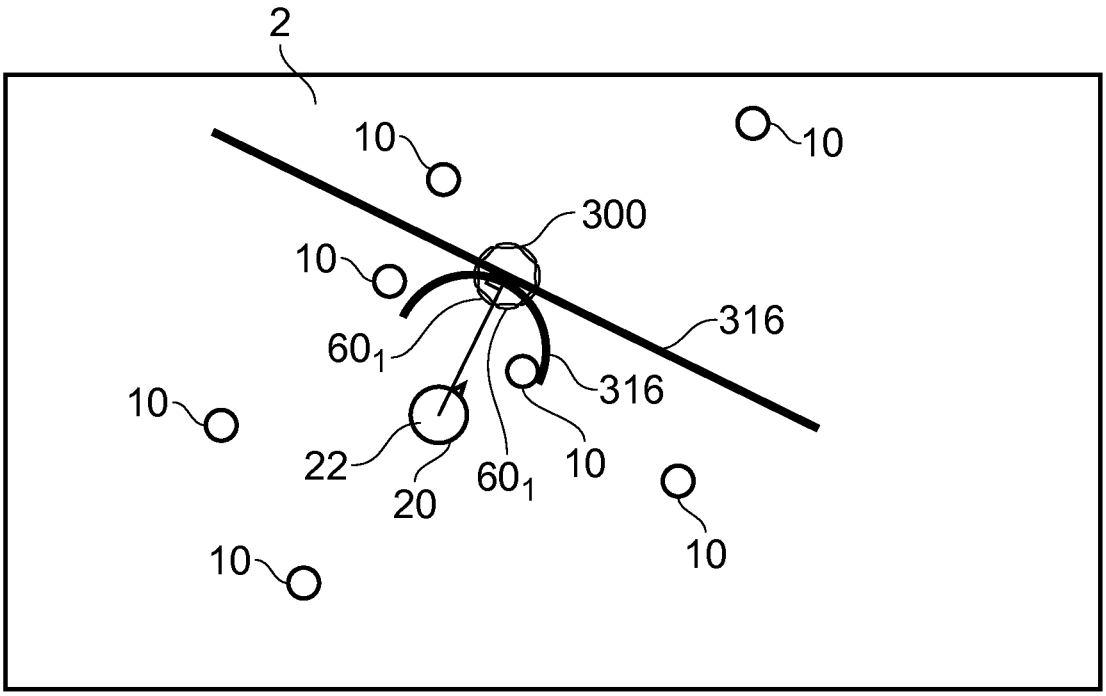
FIG. 12 shows another example embodiment of the subject matter described herein.

FIG. 12 is similar to FIG. 11 except that the selection of sound sources for the first sub set 12 and the second sub-set 14 is different. The selection of loudspeaker transducers 60 for the first sub-set 42 of output audio channels 40 can also be different.

The first vector 312 between the position 22 of the user 20 in the sound space 2 is replaced by a threshold line 316 and can have a variable shape. The variable shape may be controlled by the user. Sound sources 10 can be allocated to the first sub-set 12 using a rule based on the threshold line 316 as described using the first vector 312 for FIG. 11.

The user can therefore control where the boundary between 'direct' and 'indirect' sound sources lies by varying the threshold line 316

Two example shape alternatives for the threshold line 316 are shown in the figure. The shapes can be user adjustable and/or adapted to a configuration of the loudspeaker system 300 and the user's distance from the loudspeaker system 300.

Figure 13:
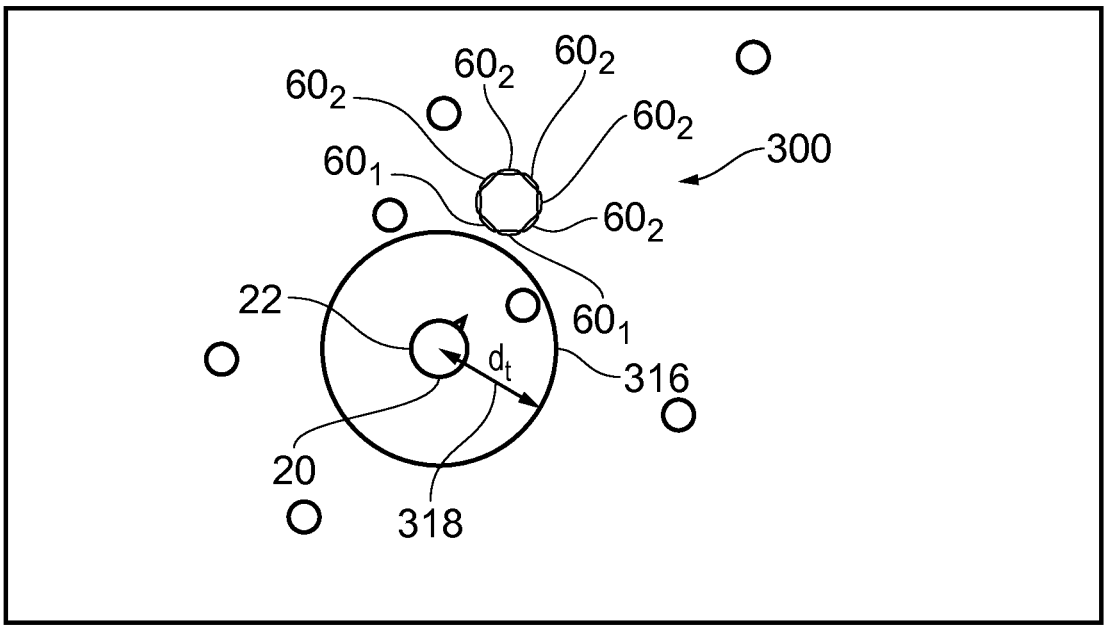
FIG. 13 shows another example embodiment of the subject matter described herein.

FIG. 13 is similar to FIG. 10 except that the selection of sound sources 10 for the first sub set 12 and the second sub-set 14 is different. The selection of loudspeaker transducers 60 for the first sub-set 42 of output audio channels 40 can also be different.

The allocation of sound sources 10 to the sub-set 12, 14 is dependent upon a distance d from the position 22 of the user 20 in the sound space 2 to the plurality of sound sources 10. Those sound sources that are within a threshold distance 318 are allocated to the first sub-set 12 and some or all of the remaining sound sources 10 as allocated to the second sub-set 14. The rule for allocating a sound source 10 may have additional constraints such as, for example a position relative to the loudspeaker system 300 or the user 20.

The first sub-set 42 of the multiple audio output channels 40 is for direct rendering and the second sub-set 44 of the multiple audio output channels 40 is for indirect rendering.

The sound sources 10 that are close to the user are mapped to the 'direct' loudspeaker transducers 60 closest the user (the first set 42 of the output audio channels 40) the others to the 'indirect' loudspeaker transducers 60 (the second set 44 of the output audio channels 40). This will cause the sound sources 10 that are close to the user to be heard more clearly with less reverberation than the other sound sources 10 due to them being rendered from loudspeaker transducers 60 facing the user (the 'direct' set of loudspeaker transducers 60).

It will be appreciated from FIGS. 9 to 13 that the available audio paths for the multiple audio output channels 40 are either direct audio paths from loudspeaker transducers 60 or indirect audio paths from loudspeaker transducers 60.

An allocation of the multiple audio output channels 40 to either the first sub-set 42 of the multiple audio output channels 40 or the second sub-set 44 of the multiple audio output channels 40 is dependent upon available direct audio paths and indirect audio paths from loudspeaker transducers 60.

The apparatus 100 comprises means for:

obtaining an indication of a variable position 52 of at least one user 50 in real space 54; mapping the position 52 of the user 50 in real space 54 to a position 22 of the user 20 in a sound space 2; and controlling an output audio signal 30, for rendering a sound scene 70 by a loudspeaker system 300 comprising multiple transducers 60 clustered around a reference position 440 that is closer to the transducers 60 than the position 22 of the user 20 in the sound space 2, to provide rendering of a first sub-set 12 of sound sources 10 from at least a first sub-set 601 of the multiple transducers and rendering a second sub-set 14 of sound sources 10 from at least a second sub-set 602 of the multiple transducers, wherein an allocation of a plurality of sound sources 10 to either the first sub-set 12 of sound sources or the second sub-set 14 of sound sources is dependent upon at least a position 22 of the user 20 in the sound space 2; and wherein an allocation of the multiple transducers 60 to either the first sub-set 601 of transducers or the second sub-set 602 of transducers is dependent upon at least a position 22 of the user 20 relative to the reference position 440.

Although in the examples described, the loudspeaker system 300 comprise multiple loudspeaker transducers 60 that can be independently controlled, in other examples the loudspeaker system 300 may comprise only one loudspeaker transducer 60 for monophonic output.

In the preceding paragraphs reference has been made to a loudspeaker transducer 60. A loudspeaker transducer is a device that receives an electrical or electromagnetic signal and produces audible sound. A transducer 60 may comprise one or more elements, for example diaphragms, that are driven synchronously.

It is desirable for a sound source to appear relatively stable in order not to degrade the listening experience. The allocation of sound sources 10 to output audio channels 40 can thus include a hysteresis effect where rapid changes in allocation back and forth are prevented. As a consequence, a user may inadvertently or on purpose move slightly back and forth without repeatedly changing the allocation of sound sources to audio output channels 40.

While FIG. 7A illustrates the server 402 and the loudspeaker system 300 and the positioning system 404 as separate entities, in other examples any combination of the server 402 and the loudspeaker system 300 and the positioning system 404 may be integrated together as a single entity. Thus, the loudspeaker system 300 may comprise the server 402 and/or comprise some or all of the positioning system 404.

Various process and rules have been described for the allocation of sound sources and the allocation of output audio channels 40. The allocation can be fully automatic or partially automatic (automatic). Parameters used in the allocation may be varied by the user giving the user control over the allocation. For example, the user may adjust the division between 'indirect' or 'direct' sound sources and/or adjust the division between 'indirect' or 'direct' audio output channels 40 e.g. loudspeaker transducers 60.

The user may change the listening point, defined by the loudspeaker position, manually, for example, using a user interface on the apparatus 100.

In one use case, a user 50 has access to spatial audio content (e.g. 6DoF/volumetric audio content) 423 that he wants to listen to. It may, for example, relate to an audio space 2 comprising musical instrument tracks as sound sources 10 that have been placed in different positions in the sound space 2. The user 50 wants to listen to the volumetric content 423, but does not have access to an appropriate speaker setup and does not want to listen to it using headphones.

The user 50 places the loudspeaker system 300 at a position inside the real space 54 corresponding to the sound space 2 of the volumetric/6DoF content 423 and hears the content associated with a position of the loudspeaker system 300. The content is that which would be heard from the position of the loudspeaker system 300 but rendered as a down mix via the loudspeaker system 300. Some of the sound sources 10 are rendered directly to the user 50 via the loudspeaker transducers 60 closest to and directed at the user 50 and some of the sound sources are rendered via the other loudspeaker transducers 60 of the loudspeaker system 300. The user's position has a meaningful effect on the audio rendered as it changes which sound sources 10 are directly rendered and which sound sources are indirectly rendered.

Referring back to FIG. 9, sound sources 10 depicted in the FIG. 9 depict the positions of the sound sources (audio objects) in the virtual, 6DoF sound space 2. They do not depict the positions of the sound objects 10 as perceived by the user; the user perceives the rendered audio from the direction of the loudspeaker system 300 (direct sound sources) and hear parts of the spatial audio scene (indirect sound sources) via reflections from walls, furniture, etc. around the loudspeaker system 300.

The position of the user 50 relative to the loudspeaker system 300 determines a division of the loudspeaker transducers 60 into two sets: one set 42 of loudspeaker transducers that face the user and one set 44 of loudspeaker transducers 60 that face away from the user 50.

The position of the user 20 relative to the audio objects 10 in the sound space and/or the loudspeaker system 300 determines how and from which loudspeaker transducer 60 they will be rendered from. In one embodiment, sound sources (e.g. audio objects) close to the user will be rendered from the set 42 facing the user 50 and the other sound sources 10 from the set 44 facing away from the user 50.

This will cause sound sources 10 that are close to the user 50 to be heard by the user directly from the loudspeaker transducers 60 facing the user 50. The other sound sources 10 will be heard through sound reflections bounced from the walls and other solid objects as the loudspeaker transducers are facing away from the user. Thus the sound sources 10 close to the user will be heard more clearly and sharply whereas sound sources 10 rendered from the rear loudspeaker transducers 60 will be diffuse and reverberant, i.e., they will not have any apparent direction-of-arrival (DOA).

Using the apparatus 100 allows a user 50 to listen to volumetric content even through a portable loudspeaker system 300. As the user's position 52 is reflected in the audio from the loudspeaker system 300 the experience is more immersive. Furthermore, the user 50 is able to adjust the audio to his liking in an intuitive way by walking to different positions 52 around the loudspeaker system 300 and adjusting the shape of the 'border' 314, 316 dividing direct and indirect sound sources (See FIGS. 11 & 12) enabling for more or less focused direct sound production.

Other examples of uses include:

The user 50 has setup the loudspeaker system 300 in his living room at a nice spot. He is listening to the music in the kitchen while cooking. A violin solo is about to start in the song being played. The user 50 walks into the living room to hear it better, the system starts to track the user 50 as the user 50 moves to a position near the violin to hear it better and more clearly through the 'direct' speakers 601.

The user 50 is listening to a broadcast from a cocktail party where there is an acoustic duo playing and many people talking around tables. The user 50 changes the speaker 'rendering location' to in the middle of the sound space 2. Now, the direct sounds are coming from the acoustic duo towards the user 50 and the talking audience will be played as indirect sounds away from the user 50. In case the user wants to hear those discussions in more detail, he can move around the loudspeaker system 300 and the audience will be rendered directly to the user (and music rendered indirectly).

The user 50 enters a room with the loudspeaker system 300 playing a piece of music. He is unhappy with the mix and requests the system to start tracking him. He walks around the room to different position while listening to the music. He finds a good mix and continues to listen to the music. The user may then switch off tracking.

The user 50 uses a user interface to control the direct-indirect border 316. A jazz big band is playing and the user 50 wants to explore the instruments in a very focused way. He adjusts the direct-indirect border shape to only include a narrow area for direct sound sources 10 and thus when he moves around the listening area, specific instruments will be heard very distinctly. In this case the user 50 has defined a narrower area from which the sound sources 10 are produced in direct manner.

The proposed use case examples provide an intuitive and effective control of spatial audio rendering from a single loudspeaker system 300. The user can easily select what part of the spatial audio content 423 will be rendered directly towards the user 50 and those sounds will be heard more clearly as other sounds are played away from the user getting more diffused.

The output audio signal 30 may for example be a single channel signal (a monophonic signal) or a multi-channel signal formed by mixing audio signals representing spatial audio content.

The spatial audio content may be provided in a native format that cannot be properly rendered by the loudspeaker system 300 such as a multi-channel format, for example, binaural format, a parametric spatial audio format such as Directional Audio Coding (DirAC), multi-channel loudspeaker format, for example, 5.1 surround sound. The multi-channels of the spatial audio content are re-mixed, for example down-mixed, by synthesis circuitry in the apparatus to a simplified format that can be properly rendered by the loudspeaker system 300 such as a single channel (monophonic) format or, if appropriate a stereo format or other format.

Thus, in some but not necessarily all examples, the synthesis circuitry 434 is configured to produce an audio signal 30 that although down-mixed and no longer fully encoding the original sound field encoded by the spatial audio content still retains some spatial audio characteristic by being dependent upon the relative position (orientation and/or distance) of the user to the loudspeaker.

For example, the synthesis circuitry 434 can be configured to convert the position in the real space of the user to a position within the sound space relative to the loudspeaker system 300, and control an output audio signal 30, for rendering a sound scene 70 by the loudspeaker system 300, the sound scene 70 being determined in dependence upon that position of the user within the sound space. For example, the position of the user 10 determines what portion of a sound space is rendered directly by the loudspeaker system 300 and what portion of a sound space is rendered indirectly by the loudspeaker system 300.

As an example, in some but not necessarily all implementations, the user is able to re-position themselves in the real space, and that position is converted to a position within the sound space by the synthesis circuitry 434, and the sound scene rendered by the loudspeaker is determined by that position within the sound space. When the user moves to a new position in the real space, that new real position is converted to a new position within the sound space, and a new sound scene is rendered by the loudspeaker that is determined by that new position within the sound space.

Although the sound scene rendered by the loudspeaker system 300 is a sound scene determined in dependence upon a corresponding position within the sound space of the user 10 and therefore has spatial characteristic it is not necessarily rendered as spatial audio because the loudspeaker cannot necessarily produce a spatially varying sound field that can locate sound sources at different positions.

The user's position affects the audio rendered from the loudspeaker creating a spatial characteristic and making the experience more interactive and engaging. The user is able to adjust the audio to his liking in an intuitive way by walking to different positions around the loudspeaker.

For example, in some but not necessarily all examples, the synthesis circuitry 434 is configured to control an intensity of a sound source rendered in dependence upon a relative distance of the user from the loudspeaker. For example, the intensity may scale as the inverse square of that distance.

In some but not necessarily all examples amplitude panning techniques may be used to create a sound object. To render spatial audio content fully left, it is mixed completely to the left transducer of the loudspeaker, and correspondingly fully right when the spatial audio content is fully right. When the sound source is in the center, spatial audio content is mixed with equal gain to the two transducers of the loudspeaker. When the spatial sound source is in between full left and full right positions, methods of amplitude panning are used to position the audio. For example, the known method of vector-base amplitude panning (VBAP) can be used When the audio content 423 comprises audio objects, the audio object is fed to a delay line and the direct sound and directional early reflections are read at suitable delays. The delays corresponding to early reflections can be obtained by analyzing the time delays of the early reflections from a measured or idealized room impulse response.

The direct sound is fed to a source directivity and/or distance/gain attenuation modelling filter T0(z). This applies level adjustment and directionality processing. The attenuated and directionally-filtered direct sound is then passed to a reverberator which produces incoherent output.

Each of the directional early reflections is fed to a source directivity and/or distance/gain attenuation modelling filter Ti(z). This applies level adjustment and directionality processing.

The attenuated and directionally-filtered direct sound and the attenuated and directionally-filtered directional early reflections are mixed together with the incoherent output at a mixer.

Control parameters may be used to control delays in the delay line; directivity and/or distance/gain at the filters; reverberation parameters of the reverberator; the respective gains applied to the directionally-filtered direct sound and the attenuated and directionally-filtered directional early reflections and the incoherent output, at the mixer.

Some control parameters may be included in or associated with the audio content 423. The control parameters vary based on loudspeaker position and user position to achieve the effects described above.

Distance rendering is in practice done by modifying the gain and direct to indirect ratio (or direct to ambient ratio).

For example, the direct signal gain can be modified according to 1/distance so that sounds which are farther away get quieter inversely proportionally to the distance.

The direct to indirect ratio decreases when objects get farther. A simple implementation can keep the indirect gain constant within the listening space and then apply distance/gain attenuation to the direct part.

Alternatively, gain for direct is maximal when the sound object is close and gain for indirect is maximal when the sound object is far.

The other audio objects are processed similarly, and then summed together to form a monophonic output as the audio signal 30.

The audio signal content in this single channel reflects the object position in the audio scene if room reflections are modified and synthesized according to object position in the audio scene. However, it does not contain spatial information which would enable creating a spatial percept for the listener.

Although the audio content 423 may encode the spatial audio as audio objects, in other examples the spatial audio may be encoded as audio signals with parametric side information.

The audio signals can be, for example, First Order Ambisonics (FOA) or its special case B-format, Higher Order Ambisonics (HOA) signals or mid-side stereo. For such audio signals, synthesis which utilizes the audio signals and the parametric metadata is used to synthesize the audio scene so that a desired spatial perception is created.

The parametric metadata may be produced by different techniques.

For example, Nokia's spatial audio capture (OZO Audio) or Directional Audio Coding (DirAC) can be used. Both capture a sound field and represent it using parametric metadata.

The parametric metadata may for example comprise:

direction parameters that indicate direction per frequency band;

distance parameters that indicate distance per frequency band;

energy-split parameters that indicate diffuse-to-total energy ratio per frequency band.

The energy-split parameters may be a ratio of diffuse energy to total energy, for example, as applied in the context of DirAC. The energy-split parameters may be a ratio of direct energy to total energy, for example, as applied in the context of OZO Audio. Either of these parameters can be used and one can be converted to the other as total energy=direct energy+diffuse energy.

If one considers each time-frequency tile of a virtual microphone signal as a separate sound source then in the synthesis circuitry, the direction parameter for that source controls vector based amplitude panning for a direct version of that virtual sound source and the energy-split parameter controls differential gain applied to the direct version of the virtual sound source and applied to an indirect version of the virtual sound source.

The indirect version of the virtual sound source is passed through a decorrelator. The direct version of the virtual sound source is not.

The synthesis circuitry 434 controls the audio signal 30 by modifying the parametric metadata for each time-space frequency tile and treating each time-space frequency tile as a separate virtual sound source.

This has the effect of changing the differential gains between the direct (dry) version' and the indirect (wet) version of the virtual sound source. And this effect may be achieved, by modifying the parametric metadata or without modification of the parametric metadata as illustrated by additional gain for the direct version of the virtual sound source and additional gain for the indirect version of the virtual sound source. The additional gains are controlled via control parameters.

The resulting direct version of the virtual sound source and indirect version of the virtual sound source are mixed together at a mixer to produce an audio signal for that virtual sound source. The audio signals for the multiple virtual sound sources are mixed together to create the output audio signal.

In the example illustrated a common decorrelation filtering is applied across all sound objects by a decorrelator. In other examples this may be varied. The decorrelation filter may be different for each spatial direction, for example, for each loudspeaker channel.

In an alternative example, VBAP and creation of loudspeaker signals can be omitted and the mono mix created directly from summed output of direct and indirect versions for each time-frequency tile.

MPEG-I Audio is currently developing spatial audio formats. This disclosure enables such an audio format to be rendered on lower capability devices, for example, stereo (without binaural rendering) and/or monophonic playback capable devices.

In some examples, the apparatus 100 may comprise the loudspeaker system 300 and positioning system 404 within a portable electronic device. For example, the position of the user 50 is tracked by tracking a head position of a user 50 of the portable electronic device using a camera of the portable electronic device.

Where a structural feature has been described, it may be replaced by means for performing one or more of the functions of the structural feature whether that function or those functions are explicitly or implicitly described.

The above described examples find application as enabling components of:

automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature) or combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

We claim:

1. An apparatus comprising:

at least one processor; and at least one memory including computer program code, the at least one memory and the computer program code configured to, with the at least one processor, cause the apparatus to perform at least the following:

obtain an indication of a position of at least one user in real space;

map the position of the user in real space to a position of the user in a sound space; and control a plurality of output audio signals, for rendering a sound scene via a plurality of audio output channels, to provide rendering of a first sub-set of sound sources via at least a first sub-set of the plurality of audio output channels and rendering a second sub-set of sound sources via at least a second sub-set of the plurality of audio output channels, wherein the first sub-set of sound sources comprises sound sources located within a defined distance of a speaker transducer directed at the user and the second sub-set of sound sources comprises sound sources outside the defined distance;

wherein an allocation of a plurality of sound sources to the first sub-set of sound sources or the second sub-set of sound sources is dependent upon at least a position of the user in the sound space;

wherein an allocation of the plurality of audio output channels to the first sub-set of the plurality of audio output channels or the second sub-set of the plurality of audio output channels is dependent upon available audio paths for the plurality of audio output channels.

2. The apparatus as claimed in claim 1, wherein an audio path for an audio output channel is an available audio path if it is a direct audio path to the user.

3. The apparatus as claimed in claim 1, wherein an audio path for an audio output channel is an available audio path if it is a direct path to the user in real space from a loudspeaker or a direct path to the user in the sound space from a sound source or a virtual loudspeaker.

4. The apparatus as claimed in claim 1, wherein the allocation to the first sub-set of sound sources is an allocation to cause direct rendering and allocation of the second sub-set of sound sources is an allocation to cause indirect rendering.

5. The apparatus as claimed in claim 4, wherein the sound sources for direct rendering and the sound sources for indirect rendering are identified based on the position of the user in the sound space.

6. The apparatus as claimed in claim 1, wherein an allocation of a plurality of sound sources to the first sub-set or the second sub-set is dependent upon at least a position of the user in the sound space relative to a reference position in the sound space.

7. The apparatus as claimed in claim 1, wherein an allocation of a plurality of sound sources to the first sub-set or the second sub-set is dependent upon at least a position of the user in the sound space relative to the plurality of sound sources.

8. The apparatus as claimed in claim 1, wherein the available audio paths for the plurality of audio output channels are dependent upon at least a position of the user.

9. The apparatus as claimed in claim 1, wherein the allocation to the first sub-set of sound sources is an allocation to cause rendering of the first sub-set of sound sources from a first set of transducers and the allocation of the second sub-set of sound sources is an allocation to cause rendering of second sub-set of sound sources from a second set of transducers, wherein the transducers in the first set of transducers are closer to the position of the user compared to any of the transducers in the second set of transducers.

10. A system comprising the apparatus as claimed in in claim 1 and a loudspeaker system comprising multiple transducers clustered around a reference position for rendering the sound scene via the plurality of audio channels, wherein the reference position is at most a first distance from the multiple transducers and wherein the reference position is a second distance from the position of the user in the real space, and wherein the first distance is less than the second distance.

11. The system as claimed in claim 10, wherein the multiple transducers clustered around the reference position face outwardly away from the reference position.

12. The system as claimed in claim 10, wherein available audio paths for the plurality of audio output channels are dependent upon at least a position of the user relative to the reference position.

13. A method comprising:

obtaining an indication of a position of at least one user in real space;

mapping the position of the user in real space to a position of the user in a sound space; and controlling a plurality of output audio signals, for rendering a sound scene via a plurality of audio output channels, to provide rendering of a first sub-set of sound sources via at least a first sub-set of the plurality of audio output channels and rendering a second sub-set of sound sources via at least a second sub-set of the plurality of audio output channels, wherein the first sub-set of sound sources comprises sound sources located within a defined distance of a speaker transducer directed at the user and the second sub-set of sound sources comprises sound sources outside the defined distance;

wherein an allocation of a plurality of sound sources to the first sub-set of sound sources or the second sub-set of sound sources is dependent upon at least a position of the user in the sound space;

wherein an allocation of the plurality of audio output channels to the first sub-set of the plurality of audio output channels or the second sub-set of the plurality of audio output channels is dependent upon available audio paths for the plurality of audio output channels.

14. The method as claimed in claim 13, wherein an audio path for an audio output channel is an available audio path if it is a direct audio path to the user.

15. The method as claimed in claim 13, wherein an audio path for an audio output channel is an available audio path if it is a direct path to the user in real space from a loudspeaker or a direct path to the user in the sound space from a sound source or a virtual loudspeaker.

16. The method as claimed in claim 13, wherein the allocation to the first sub-set of sound sources is an allocation to cause direct rendering and allocation of the second sub-set of sound sources is an allocation to cause indirect rendering.

17. The method as claimed in claim 16, wherein the sound sources for direct rendering and the sound sources for indirect rendering are identified based on the position of the user in the sound space.

18. The method as claimed in claim 13, wherein an allocation of a plurality of sound sources to the first sub-set or the second sub-set is dependent upon at least a position of the user in the sound space relative to a reference position in the sound space.

19. The method as claimed in claim 13, wherein an allocation of a plurality of sound sources to the first sub-set or the second sub-set is dependent upon at least a position of the user in the sound space relative to the plurality of sound sources.

20. A non-transitory computer readable medium comprising program instructions stored thereon for performing at least the following:

mapping a position of the user in real space to a position of the user in a sound space; and controlling a plurality of output audio signals, for rendering a sound scene via a plurality of audio output channels, to provide rendering of a first sub-set of sound sources via at least a first sub-set of the plurality of audio output channels and rendering a second sub-set of sound sources via at least a second sub-set of the plurality of audio output channels, wherein the first sub-set of sound sources comprises sound sources located within a defined distance of a speaker transducer directed at the user and the second sub-set of sound sources comprises sound sources outside the defined distance;

wherein an allocation of a plurality of sound sources to the first sub-set of sound sources or the second sub-set of sound sources is dependent upon at least a position of the user in the sound space;

wherein an allocation of the plurality of audio output channels to the first sub-set of the plurality of audio output channels or the second sub-set of the plurality of audio output channels is dependent upon available audio paths for the plurality of audio output channels.

* * * * *